United States Patent [19]

Caton et al.

[11] 3,944,140

[45] Mar. 16, 1976

[54] SHOWER HEAD

[75] Inventors: Joe L. Caton; Larry Caton, both of Ceres, Calif.

[73] Assignee: Lawrence Peska Associates, Inc., New York, N.Y. ; a part interest

[22] Filed: Mar. 24, 1975

[21] Appl. No.: 561,054

[52] U.S. Cl. ..... 239/315; 239/383; 239/389; 15/24; 401/81; 401/201

[51] Int. Cl.[2] ..... B05B 7/28

[58] Field of Search ..... 15/50 R, 69, 24; 401/81, 401/196, 201, 271, 282, 283, 4; 239/310, 315, 316, 383, 389

[56] References Cited

UNITED STATES PATENTS

| | | | |
|---|---|---|---|
| 1,023,708 | 4/1912 | Arundel | 15/50 R |
| 1,117,634 | 11/1914 | Bowes | 401/81 X |
| 1,668,802 | 5/1928 | Cantrell | 239/310 X |
| 1,679,561 | 8/1928 | Cantrell | 239/310 X |
| 1,751,524 | 3/1930 | Moss | 239/315 |
| 1,951,273 | 3/1934 | Dalgleish | 15/69 X |
| 2,019,705 | 11/1935 | Hubert | 15/69 X |
| 2,986,340 | 5/1961 | Webb | 239/316 X |

*Primary Examiner*—Robert S. Ward, Jr.

[57] ABSTRACT

A shower head adapted to mix and dispense a detergent and water is disclosed. A rotational shaft with impeller blades mounted on one end and a rotary brush engaging a detergent bar on the other end is rotated in a shower head when water under pressure flowing through the shower head impinges on the blades. Means are employed to keep the rotary brush in contact with the detergent bar when the detergent bar is being consumed during use. Means for diverting water toward or away from the impeller blades are also provided so that a bather may adjust the shower head during use to provide water or a mixture of water and a detergent.

3 Claims, 3 Drawing Figures

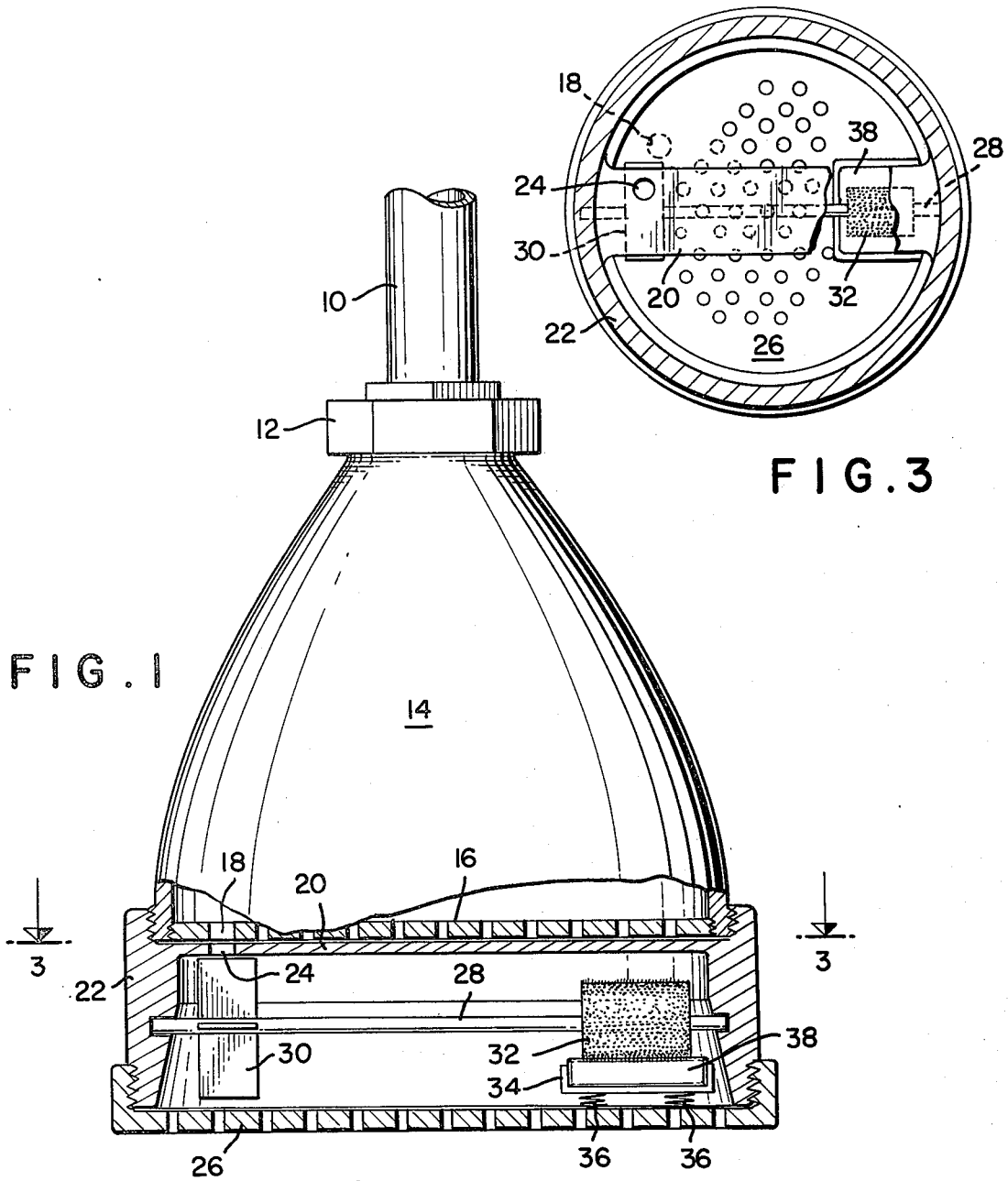
FIG. 3
FIG. 1
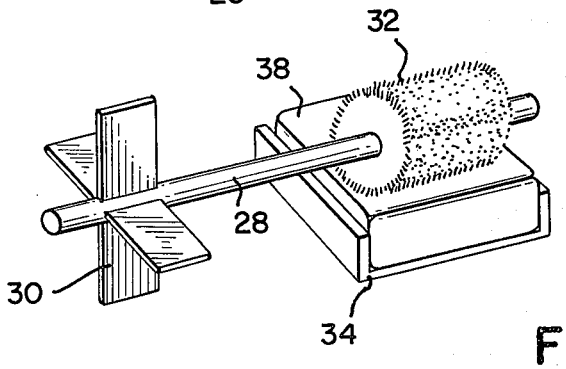
FIG. 2

SHOWER HEAD

The present invention relates to a shower head adapted to mix and dispense a detergent and water.

An object of the invention is to provide means for mixing and dispensing a solid or a liquid chemical compound with a fluid such as a liquid or a gas.

A further object of the invention is to provide means for supplying a fluid by itself and which means can be adjusted to mix and dispense a solid or a liquid chemical compound with such fluid.

It is also an object of this invention to provide a shower head to mix and dispense water with a detergent.

A further object of this invention is to provide a shower head for supplying water by itself but which can also be adjusted to mix and dispense a detergent and water.

These and other objects have been achieved by the present invention which will become apparent from the specifications and claims which follow taken together with the appended drawings in which:

FIG. 1 is a side view of an embodiment of the invention in assembled form;

FIG. 2 is a three dimensional view of rotary means that rotate in response to fluid flow and contacts and mixes a compound with a fluid according to the present invention;

FIG. 3 is a view partially in section taken along the line 3—3 in FIG. 1.

In FIG. 1 conduit 10 is shown which comprises influent means for introducing water under pressure into a conventional shower casing 14 which has a perforate base plate 16 with opening 18. Coupling 12 is employed to connect conduit 10 to casing 14 in a conventional manner that is known in the art. A shower head comprising collar 22 is rotationally attached to the base of casing 14. Integral with collar 22 is bridge plate 20 having opening 24 therein, bridge plate 20 also comprising the influent end of the shower head comprising collar 22. A perforate plate 26 is attached to the base of collar 22 and comprises the effluent end of the shower head comprising collar 22. The space defined by collar 22 between the influent end at bridge plate 20 and the effluent end at perforate plate 26 comprises a flow path for fluids such as water. Rotary means comprising a rotatable shaft 28 is rotationally mounted in collar 22 transverse to the flow path in the shower head on which is mounted impeller blades 30 for rotating shaft 28 and a rotary brush 33 driven by the shaft 28. Means for contacting a compound, such as a detergent, with rotary means comprising compound dispensing means and especially detergent dispensing means such as tray 34 is mounted on resilient means such as springs 36 secured to plate 26. Any detergent can be used in the apparatus of the present invention such as the saponification product of fatty acid glycerides or fatty acids and alkalis such as sodium hydroxide or alternately the alkali metal salts of alkyl aryl sulfonates or the condensation and addition products of alkylene oxides or the condensation and addition products of such alkylene oxides and aryl compounds including phenols or alkyl substituted phenols. A detergent bar such as a soap bar 38 is placed in tray 34 and is kept in contact with brush 32 by means of springs 36.

Visual inspection of the aforementioned rotary means and detergent bar is possible when collar 22 and bridge plate 20 integral therewith are made of a transparent material such as glass or a plastic material such as the various polymers and copolymers of styrene, acrylonitrile, acrylic acid, alkyl substituted acrylic acid and the various art known esters of such acids.

FIG. 2 is a three dimensional view of rotary means and detergent dispensing means in which rotary shaft 28 having impeller blades 30 and rotary brush 32, tray 34 and soap bar 38 are shown removed from the shower head of the present invention.

FIG. 3 shows a view looking downward of means for diverting the flow of water in the shower head of the present invention to thereby change the rate of rotation of the rotary means comprising shaft 28, impeller blades 30 and rotary brush 32. In the present specification and the foregoing claims when reference is made to changing the rate of rotation of the rotary means it is intended to include increasing or decreasing the rate of rotation of such means as well as completely stopping the rotary means and stopping the mixing and dispensing of the compound and fluid such as the detergent and water.

In operation, water under pressure passes through conduit 10 into casing 14 through perforate plate 16, over bridge plate 20 and out effluent end at plate 26. When opening 24 in the flow path above impeller blades 30 is in register with opening 18, water under pressure impinges upon blades 30 causing shaft 28 to rotate along with rotary brush 32 which engages detergent bar 38 and is held in such engagement by resilient means such as resilient means 36 until the detergent bar is consumed. Bridge plate 20 is arranged to slidingly engage perforate plate 16 so that opening 24 in bridge plate 20 registers with opening 18 in plate 16 whereby the flow path in which impeller blades 30 are placed will conduct water to impinge upon blades 30. Collar 22 can be rotated to cause partial registration of opening 18 with opening 24 so that the rate of rotation of the aforementioned rotary means can be reduced. Further, collar 22 can be rotated so that non-perforate area of plate 16 is placed immediately above opening 24 as is shown in FIG. 3. This arrangement as illustrated in FIG. 3 shows a manner of using the present invention to prevent water from impinging on blades 30 thereby allowing a bather to select either water or a mixture of water and a detergent from the shower head.

In its broadest aspect, the present invention relates to not only the shower head as described above, but also relates to means for mixing a chemical compound such as a liquid or a solid with a fluid such as a liquid or a gas.

Although the invention has been described by reference to some embodiments it is not intended that it is to be limited thereby since certain modifications thereof are intended to be included within the broad scope and spirit of the foregoing disclosure and the following claims.

What is claimed is:

1. Means for mixing and dispensing comprising a shower head for mixing and dispensing a detergent with water, said shower head having a housing defining a flow path intermediate influent means adapted to receive a source of water under pressure and effluent means, shaft means rotatingly mounted in said housing and transverse to said flow path, said shaft having impeller blade means mounted thereon and in said flowpath so that said blade means rotate said shaft when water under pressure impinges on said blade means, rotary brush means mounted on said shaft for rotatingly engaging a detergent bar, tray means arranged for presenting a detergent bar for engagement with said brush means, resilient means arranged to allow continuous engagement of a detergent bar with said brush means while such detergent bar is being consumed during use.

2. The shower head of claim 1 further comprising plate means mounted in said housing and transverse to said flow path, said plate means having opening means adjustable to register with the flow path in which said impeller blades are placed to divert flow of water in said flow path in which said blades are placed toward and away from said blades to change the rate of rotation of said blades, said plate means having further opening means to allow water to flow in said flow path and out of said effluent means.

3. The shower head of claim 2 where said plate means mounted in said housing comprises first fixed perforate plate means with first opening means for registration with said flow path in which said impeller blades are mounted and second plate means with second opening means, said second plate means slidingly engaging said first plate means to register and second opening means with said first opening means, collar means integral with and on the periphery of said second plate means, said shaft means being rotatably mounted on said collar.

* * * * *